United States Patent [19]

Shannon et al.

[11] Patent Number: 5,029,344

[45] Date of Patent: Jul. 9, 1991

[54] DOUBLE-REVERSIBLE GARMENTS

[76] Inventors: Thomas D. Shannon; Catherine B. Monnier, both of 116 Franklin St., New York, N.Y. 10013

[21] Appl. No.: 578,741

[22] Filed: Sep. 6, 1990

[51] Int. Cl.[5] ..... A41B 1/00

[52] U.S. Cl. ..... 2/69; 2/115; 2/85; 2/93; 2/77

[58] Field of Search ..... 2/69, DIG. 2, 115, 77, 2/85, 93

[56] References Cited

U.S. PATENT DOCUMENTS

| | | | |
|---|---|---|---|
| 2,412,988 | 12/1946 | Kleinman | 2/DIG. 2 |
| 2,422,779 | 6/1947 | Fligel | 2/DIG. 2 |
| 2,696,617 | 12/1954 | Worcester | 2/DIG. 2 |
| 2,711,539 | 6/1955 | Loscher | 2/93 |
| 3,492,676 | 2/1970 | King | 2/243 |
| 3,710,394 | 1/1973 | Trice | 2/74 |
| 4,338,686 | 7/1982 | Bell | 2/DIG. 2 |
| 4,472,835 | 9/1984 | Clark | 2/102 |

FOREIGN PATENT DOCUMENTS

| | | | |
|---|---|---|---|
| 710953 | 6/1954 | United Kingdom | 2/102 |

*Primary Examiner*—Werner H. Schroeder
*Assistant Examiner*—Gloria Hale
*Attorney, Agent, or Firm*—Peter N. Jansson, Ltd.

[57] ABSTRACT

A reversible garment has two overlying generally co-extensive sheet members, each having two opposite generally co-extensive surfaces, the sheet members having a plurality of corresponding edge pairs, the two edges of each pair of a subset of the edge pairs being parallel and proximate, and strips or other couplers pivotably coupling the two edges of at least one edge pair of such subset of edge pairs. This allows reversal and/or pivoting of the sheet members to expose any one of four surfaces as the outer surface.

22 Claims, 5 Drawing Sheets

DOUBLE-REVERSIBLE GARMENTS

FIELD OF THE INVENTION

This invention is related generally to garments and, more particularly, to reversible garments.

BACKGROUND OF THE INVENTION

Clothing serves a variety of purposes in modern life. First and foremost, since the advent of animal-skin garments, clothing provides warmth and protection from the elements. However, in more recent millenia the functional role of clothing has become more specific and aesthetic considerations have assumed at least an equally important role.

For many, to twist a popular phrase, we are what we wear. Clothing provides a sense of individual identity and distinguishes its wearer from everyone else. It permits a degree of departure from the more routine, mundane aspects of contemporary life, adding variety to the ordinary. However, even while clothing has become a preferred means of individual expression, economic concerns have not been totally displaced.

It is within this context that the concept of reversible garments was first developed. Making a garment reversible was a way to double its use and/or provide the possibility of a different look without a similar increase in cost. Advantages were achieved both in garment durability and garment versatility. A reversible garment could be worn two ways and exhibit a totally different appearance.

Reversible garments have been the subject of much development in the prior art. Typically, reversible garments rely on something of a bi-panel construction, with each panel reversibly or irreversibly connected to the other at or near and around the periphery. The simple maneuver of turning the garment "inside-out" accomplishes the reversal and allows it to be worn as a second garment, alone or in combination.

Despite the widespread use of reversible clothing the prior art has associated with it a number of significant problems and deficiencies. Most are related to the bi-panel construction, and result from the limitations inherent in the construction of the reversible garments currently worn.

One major problem of the prior art is that only two surfaces are available for wear. This limited choice severely restricts color and pattern coordination of the garment with other articles of clothing. Versatility, a prime objective of reversible clothing, is relatively limited. A related problem is that once a particular surface of the garment is worn, damaged, or faded, any such versatility, however limited, is gone altogether. Wear is then necessarily restricted to one outer surface.

Another significant concern is that reversible garments of the prior art invariably become soiled. Reversing the garment to show the clean surface necessitates that the soiled one must be worn against the skin or clean clothing. To maintain the desired versatility, the only alternative is to clean the garment, which takes time many individuals no longer have. To the extent the garment must be dry cleaned often a significant expense is incurred.

Another significant problem is that a reversible garment having one water-proof or weather-resistant surface must be worn with that surface inside when not in use. Surfaces of this type often trap moisture and body warmth, becoming uncomfortable when worn against the skin for any length of time. Other types of surfaces such as those constructed with decorative sequin, various wools, and other such fabrics are, likewise, uncomfortable.

Another major problem of the prior art is that the addition of insulation to the garment represents an additional expense. Moreover, once the garment is constructed with a bulky insulation material, a degree of versatility is lost.

In summary, a considerable number of drawbacks and problems exist in the art relating to reversible garments. There is a clear need for improvements in reversible garments.

OBJECTS OF THE INVENTION

It is an object of this invention to provide an improved reversible garment system, overcoming some of the problems and shortcomings of the prior art.

Another object of this invention is to provide much more versatility and utility, in terms of fashion and function, in reversible garments.

Another object of this invention is to provide reversible garments which give a greater number of choices to the wearer.

Another object of this invention is to provide a reversible garment which when soiled and reversed does not require that the soiled surface be worn against the wearer's skin or clean clothing.

Another object of this invention is to provide a reversible garment which requires cleaning less frequently than other similar garments.

Another object of this invention is to provide a reversible garment system with a weather-resistant surface which need not be against the skin or inner clothing even though not in use as the outermost surface.

Another object of this invention is to provide a reversible garment which may provide excellent insulation from the cold economically, comfortably, and without a loss of versatility.

These and other important objects will be apparent from the descriptions of this invention which follow.

SUMMARY OF THE INVENTION

This invention is an improved reversible garment system. The invention overcomes certain well-known problems and deficiencies of the prior art, including those outlined above.

This invention is a double-reversible garment including: (1) two overlying substantially co-extensive sheet members, each having two opposites substantially co-extensive surfaces; (2) a plurality of substantially corresponding edge pairs, the two edges of each edge pair of a subset of the edge pairs being substantially parallel and proximate; and (3) means to pivotably couple the two edges of at least one edge pair of the subset of edge pairs. Reversing and/or pivoting the sheet members of the garment allows any one of four surfaces to be worn as an outer surface. Each surface has or can have a different set of characteristics, including color, texture, and/or weatherability.

The inventive arrangement allows either a two- or four-layer double-reversible garment to be worn with any of four surfaces as the outer surface. Reversal of the garment in the manner typical of the prior art allows two of the four surfaces to be worn as the outer surface, as the wearer may choose. Pivoting the garment about the pivotable coupling means allows two additional surfaces to be worn as the outer surface, again depending on reversal of the garment in the manner typical of the prior art. In total, any one of four surfaces, each with varying characteristics, may be worn as the outer surface through simple, straight-forward manipulations.

The coupling means is preferably a flexible strip having opposite edges secured respectively to the edges of at least one edge pair of the sheet members. In one preferred embodiment, the coupling means is integral with one of the edges of the edge pair.

Where there is but one coupled edge pair the garment may form a skirt or an article of clothing which may be pulled over the torso. Where there are at least two coupled edge pairs, the garment may form a coat-like article of clothing, including jackets and shirts, or may form a skirt. There are a variety of other possibilities.

In garments of this invention having two coupled edge pairs, means to releaseably fasten the two coupled edge pairs may be included in preferred embodiments, and may exist as separate fasteners attached to the opposite sides of the coupling means. Alternatively, elongated fasteners attached to opposite sides of the coupling means and extending substantially the full length of the coupling means fasten the garment. In other preferred embodiments, the fastening means may be a separate fastener slidable through the coupling means such that it is useable with any one of the four surfaces worn as an outer surface.

In highly preferred four-layer embodiments, each sheet member has two overlying substantially co-extensive layers, each irreversibly connected to the other. As with the other embodiments, each of the four surfaces has or can have a different set of characteristics, including color, texture, and weatherability.

The coupling means of a highly preferred four-layer garment may be a flexible strip having opposite edges which are secured respectively to the edges of at least one edge pair. As with the two-layer embodiments, those having four layers may use a coupling means integral with one edge of an edge pair. Garments with four layers, as described, may form a skirt or a pull-over the torso article of clothing. In other highly preferred four-layer embodiments, there are least two coupled edge pairs. Garments of this sort may form coat-like articles of clothing, including jackets and shirts, and skirts. Again, there are a variety of possibilities.

As already noted, the double-reversible garments of this invention have certain advantages over reversible clothing of the prior art. The unique pivoting configuration of this invention allows these advantages to be realized. Versatility is enhanced beyond that available with ordinary reversible garments; a garment may have four layers, any one of which maybe chosen at any time to be worn as the outer surface.

The increased versatility is readily apparent. In a coat-like garment designed for outdoor wear the following choices can be provided: one surface may be water-repellent; the second may be solar absorptive; the third may be solar-reflective; and the fourth may be dyed for safety. A hunting jacket may have the following: one surface may have a camouflage pattern; the second may be blaze orange; the third layer black; and the fourth white. Such a garment may be useful to many outdoorsmen.

The double-reversible garments of this invention need not be restricted to a single use. The layers and surfaces which make up the garment may be designed to meet apparel needs for several diverse occasions. For example, a coat may include dress, casual, weather-resistant, and camouflaged surfaces. A double-reversible garment of the present invention is desirable to anyone who needs to change both activities and clothing quickly. An added advantage comes to a traveler who can reduce the amount and weight of her luggage without choosing one garment over another. Unforeseen apparel needs may be met without packing extra clothing or buying more during travel.

The double-reversible garments of this invention not only enhance the functional role of clothing, but also contribute aesthetically. A skirt, sweater, or jacket may be simultaneously available in four different combinations of color, pattern, or texture. Many more clothing combinations or ensembles are possible than are with regular clothing or reversible garments of the prior art. Inasmuch as clothing, for most individuals, represents a major expense, use of double-reversible garments of the present invention will result in a considerable cost-savings.

As is often the case with clothing, especially outerwear, it becomes soiled over time. With reversible garments of the prior art, upon reversal the soiled surface is necessarily worn inside, against the body or clean inner clothing. Through the use of a preferred coupling means, the garments of the present invention may be worn reversed, but without a soiled surface adjacent to the wearer's body or inner clothing. An unexpectedly soiled surface may be hidden with the garment still worn comfortably, until cleaned. To the extent such garments need to be dry cleaned, the coupling means and a choice of four surfaces represent a way to significantly reduce maintenance costs.

Double-reversible garments may provide insulation without an expensive insulating material. A combination of surface fabric and air space between the four layers of the garment provides effective insulation at no extra cost. Reversible garments of the prior art are insulated, but typically so only with insulating material inserted between the panels. Each panel thus acquires a bulky look which detracts from the versatility which underlies the entire reversible concept. Double-reversible garments of the present invention use passive insulation, thereby avoiding this problem altogether.

The double-reversible garments described herein provide a cost-effective approach to enhancing the function, versatility and aesthetics of any wardrobe. The coupling means allows two or four layers to be joined in a garment, with each available as an outside surface through an easy, quick reversing and/or pivot maneuver of the layers.

DETAILED DESCRIPTION OF PREFERRED EMBODIMENTS

The drawings illustrate a double-reversible garment system, including a preferred pivotable coupling means, as used within the four-layer embodiment of this invention.

Figure 2:
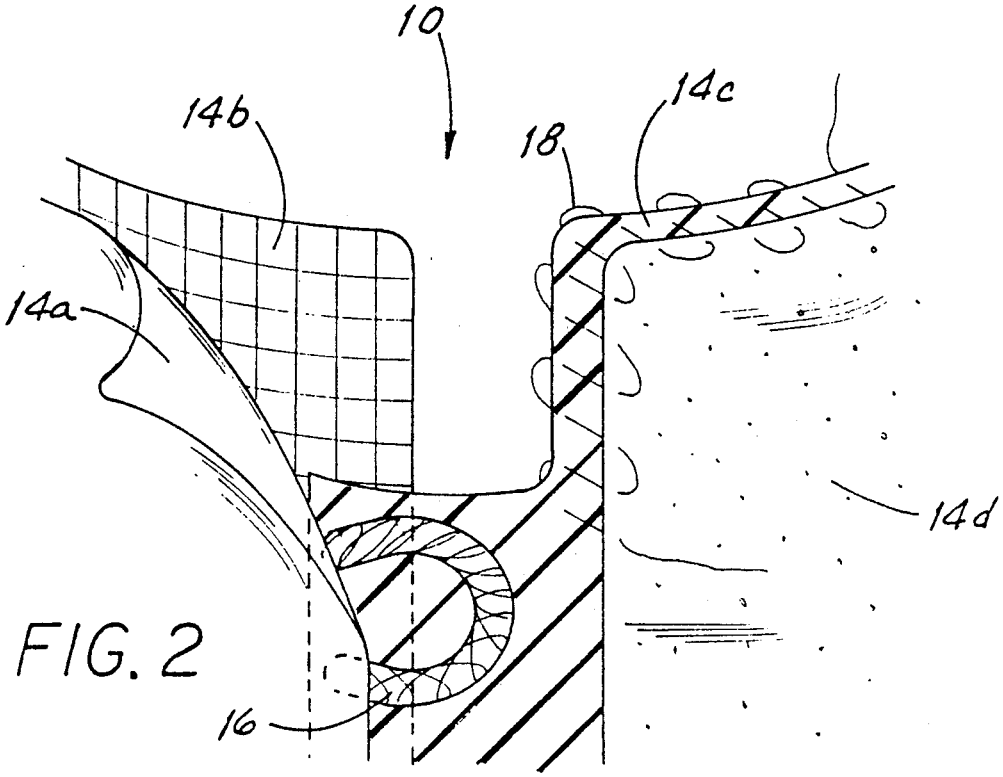
FIG. 2 is a full perspective view of a preferred coupling means of a double-reversible garment, in accordance with this invention.
Figure 1:
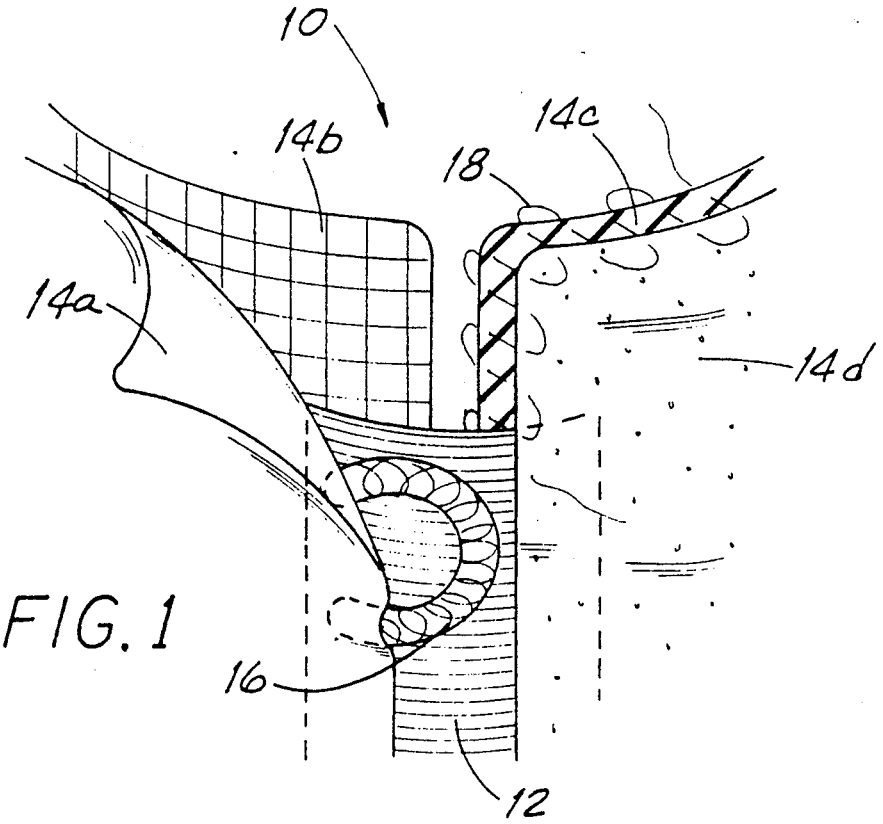
FIG. 1 is a full perspective view of a highly preferred coupling means of a double-reversible garment, in accordance with this invention

As best shown in FIG. 1, coupling means 10 is comprised of flexible strip 12, which has opposite ends secured and positioned between sheet layers 14*a* and 14*b* and 14*c* and 14*d*, respectively. The sheet layer pairs are irreversibly connected with sewn thread 18. In highly 16 is also secured between sheet layers 14*a* and 14*b* to function as part of a fastener mechanism. As shown in FIG. 2, in preferred embodiments flexible strip 12 is integral with sheet layer 14*c* and positioned and secured between sheet layers 14*a* and 14*b*, along with loop 16.

Figure 3A:
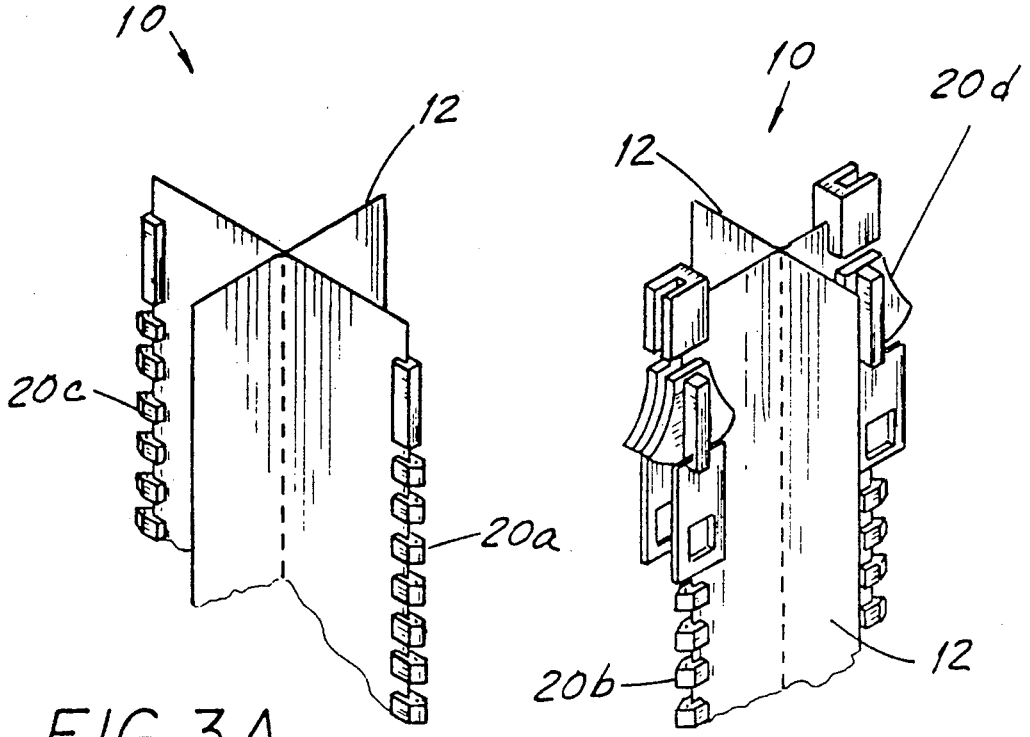
FIG. 3A is a full perspective view of a preferred coupling means in conjunction with a fastener, in accordance with this invention.
Figure 3B:
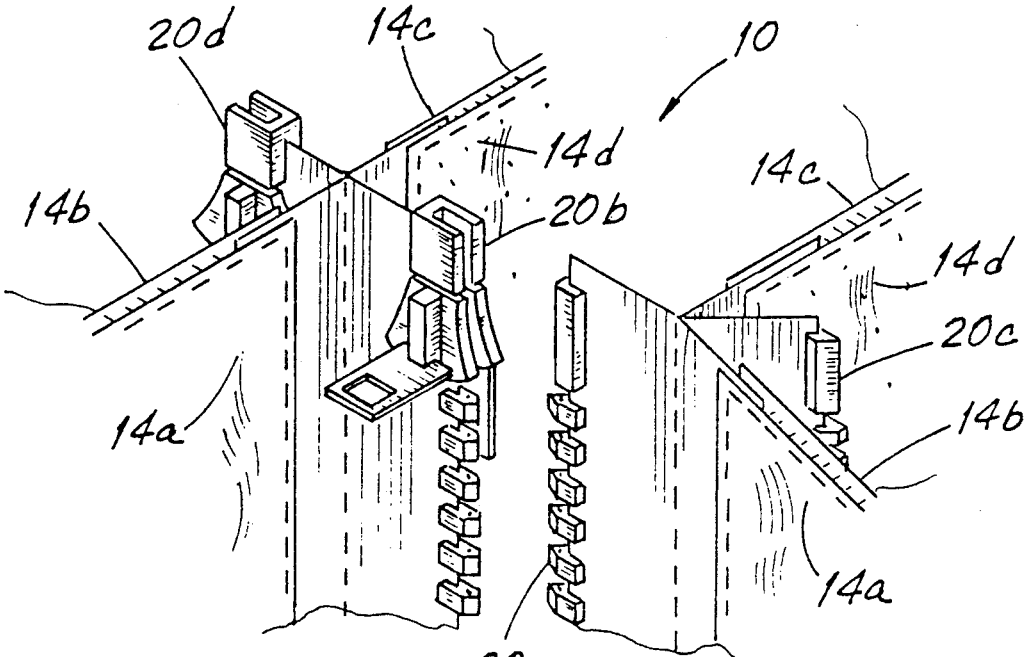
FIG. 3B is a full perspective view of a preferred coupling means in conjunction with a fastener, in accordance with this invention.

As shown in FIG. 3A, in preferred embodiments having two coupled edge pairs flexible strip 12 is comprised of two identical zipper halves 20*a* and 20*c* (and 20*b* and 20*d*) joined along their midlines, forming a coupling means which is also part of a fastener. As shown in FIG. 3B, each preferred coupling means 10 may be secured and positioned between sheet layers 14*a* and 14*b* and 14*c* and 14*d*, respectively, such that the double-reversible garment may be fastened through the interaction of zipper halves 20*a* and 20*b*. Upon reversing and turning the garment inside-out fastening is achieved through the interaction of zipper halves 20*c* and 20*d*.

Figure 4:
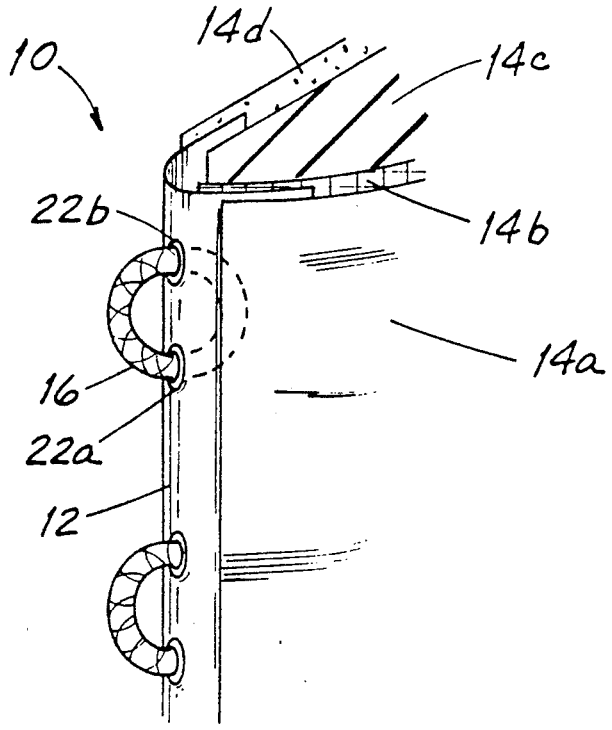
FIG. 4 is a full perspective view of a preferred coupling means in conjunction with a fastener, in accordance with this invention.

As shown in FIG. 4, in preferred coupling means 10, loop 16 is positioned through openings 22*a* and 22*b*. As before, flexible strip 12 is secured between sheet layers 14*a* and 14*b* and 14*c* and 14*d*, respectively. After reversing and turning the garment inside-out loop 16 is simply pulled through openings 22*a* and 22*b* to function as a fastener for the reversed garment.

Figure 5:
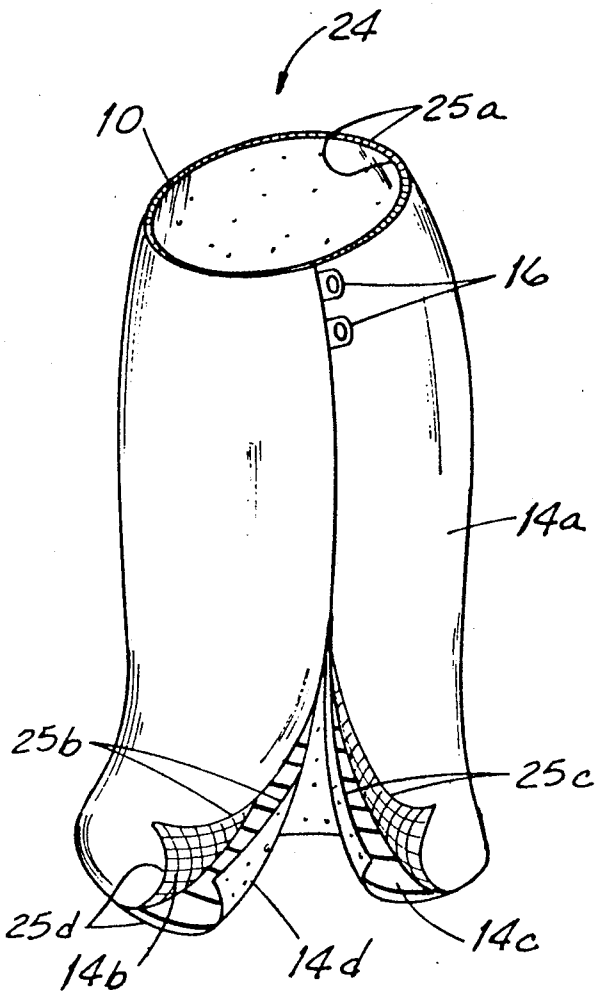
FIG. 5 is a perspective view of a skirt garment, in accordance with this invention.

Preferred embodiments of the garment of this invention may have a plurality of substantially corresponding edge pairs, as exhibited by skirt 24 shown in FIG. 5. The two edges of edge pairs 25*a*, 25*b*, 25*c*, and 25*d* are substantially parallel and proximate. In preferred embodiments, the edges of at least one edge pair are pivotably coupled. In skirt 24, the two edges of edge pair 25*a* are so coupled, while the edges of edge pairs 25*b*–25*d* are not coupled. Coupling means 10 is secured and positioned between sheet layers 14*a* and 14*b* and 14*c* and 14*d*, respectively. Loop 16 fastens skirt 24, but is not necessarily positioned between the sheet layers with flexible strip 12. Skirt 24 is reversed to show layer 14*d* as the outer surface simply by releasing loop 16 and turning the skirt inside-out. Completely pivoting layer 14*a* about coupling means 10 reveals layers 14*b* and 14*c*, each of which may then be worn as the outer surface.

Figure 6:
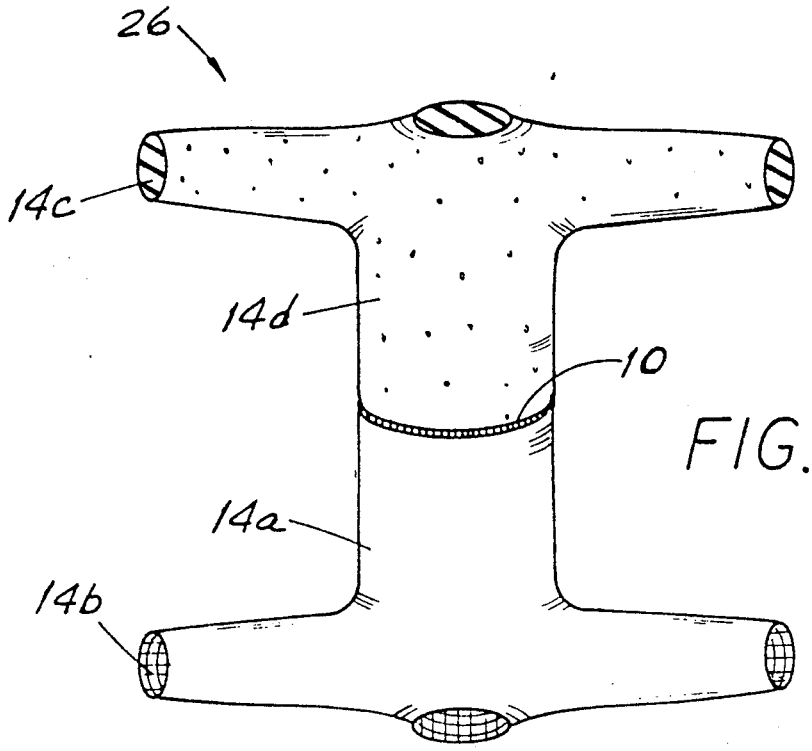
FIG. 6 is a perspective view of an extended torso-pullover garment, in accordance with this invention.

As shown in FIG. 6, another preferred embodiment having one coupled edge pair is a torso-pullover garment 26. Coupling means 10 joins sheet layers 14*a* and 14*b* and 14*c* and 14*d*, respectively, and forms the bottom of garment 26, as normally worn. Garment 26 is maneuvered about coupling means 10, as explained above for skirt 24, such that any of the four layers 14*a*, 14*b*, 14*c*, or 14*d* may be worn as the outside surface. As shown in FIG. 6, layers 14*a* and 14*b* are partially pivoted about coupling means 10. Garment 26 may be a sweater, sweatshirt, tee-shirt or some similar pull-over article of clothing.

Figure 7:
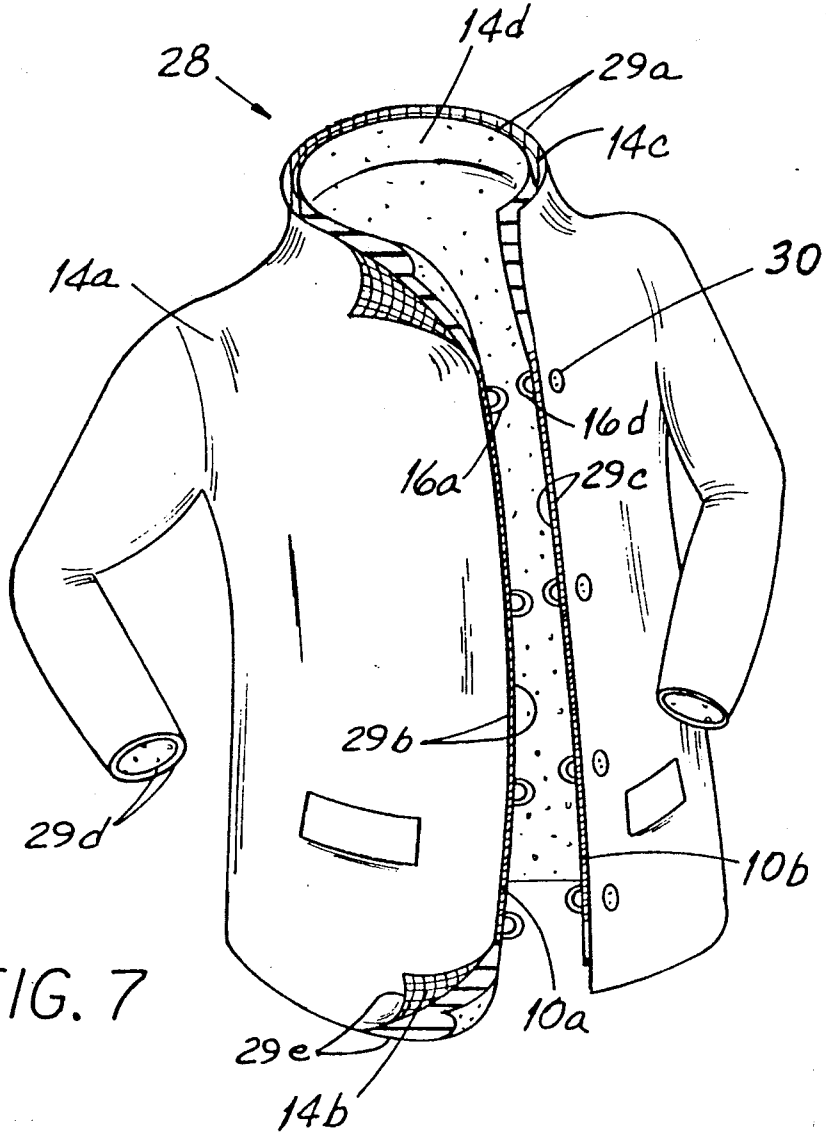
FIG. 7 is a perspective view of a coat-like garment, in accordance with this invention.

Coat-like garment 28, shown in FIG. 7, also has a plurality of substantially corresponding edge pairs. The edges of edge pairs 29*a*–29*e* are substantially parallel and proximate. The edges of edge pairs 29*b* and 29*c* are pivotably coupled, while the remaining edge pairs are not coupled. Coupling means 10*a* and 10*b* are secured and positioned between sheet layers 14*a* and 14*b* and 14*c* and 14*d*, respectively. Loop 16*a* is also positioned and secured between layers 14*a* and 14*b* for use as a fastener in conjunction with button 30. Loop 16*d* is positioned and secured between sheet layers 14*c* and 14*d* and used to fasten garment 28 when layer 14*d* is worn as the outer surface.

Figure 8:
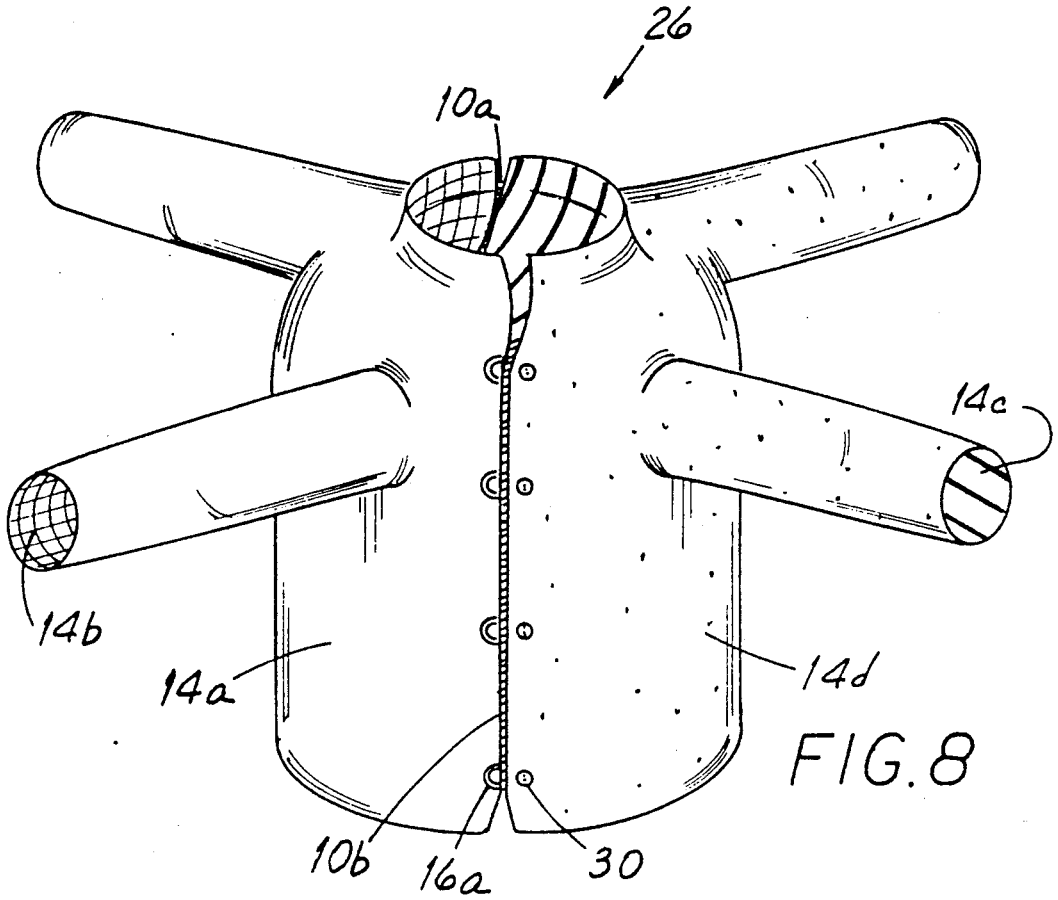
FIG. 8 is a perspective view of an extended coat-like garment, in accordance with this invention.
Figure 9:
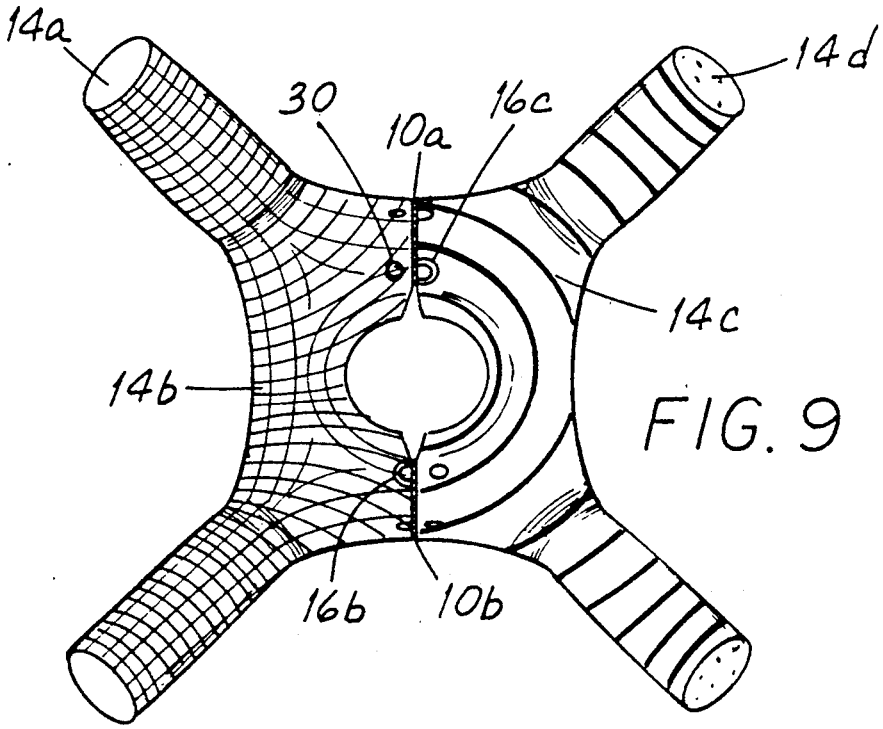
FIG. 9 is a top view of an extended coat-like garment, in accordance with this invention.

Layers 14*b* and 14*c* of garment 28 may become the outer and inner surfaces, respectively, by pulling sheet layers 14*c* and 14*d* from layers 14*a* and 14*b* in such a way that all layers pivot about coupling means 10*a* and 10*b*. *After full extension, as shown in FIG. 8, garment 28 is turned inside-out, revealing layers 14b* and 14*c*, as shown in FIG. 9. Repeating a pivot maneuver about coupling means 10*a* and 10*b* and placing layer 14*c* inside 14*b* completes the double-reversal of garment 28. Loops 16*b* and 16*c* operate in conjunction with buttons 30 to fasten layers 14*b* and 14*c*, respectively.

In preferred embodiments loop 16 is used in conjunction with button 30 to fasten garments of this invention. Either loop 16 or button 30 may be made using a variety of materials and styles. Likewise, zipper 20 may be made using any of the variety of zippers commercially available. Preferred fasteners also include velcro strip combinations alone or in conjunction with a preferred coupling means.

Acceptable material choices for layers 14*a*–*d* of this invention will be apparent to those skilled in art who are made aware of this invention. Preferred materials include flannel, denim, corduroy, gortex and other synthetic fabrics, whether or not treated for water-resistance.

Instead of the four-layered garment structures described above, this invention may be embodied in a two-layered garment structure. For example, FIG. 8 may be viewed as having two layers, including a single layer having opposite surfaces 14*a* and 14*b* and another single layer having opposite surfaces 14*c* and 14*d*. Each single layer in such situation would have different patterns or characteristics on its opposite surfaces.

This invention has been described in connection with skirt, torso pull-over, and coat-like garments. However, the invention has applications beyond those described above, including other articles of clothing.

While the principles of this invention have been described in connection with certain specific embodiments, it should be understood clearly that these descriptions are made only by way of example and are not intended to limit the scope of the invention.

I claim:

1. A garment comprising:

two overlying substantially co-extensive sheet members, each having two opposite substantially co-extensive surfaces;

the sheet members having a plurality of substantially corresponding edge pairs, the two edges of each pair of a subset of the edge pairs being substantially parallel and proximate; and means pivotably coupling the two edges of at least one edge pair of said subset of edge pairs, whereby reversing and/or pivoting of the sheet members allows the garment to be worn with any of the four surfaces as an outer surface.

2. The garment of claim 1 wherein each of the surfaces has a characteristic different than a comparable characteristic of each of the other surfaces.

3. The garment of claim 2 wherein each of the surfaces has a color different than the colors of each of the other surfaces.

4. The garment of claim 2 wherein each of the surfaces has a texture different than the textures of each of the other surfaces.

5. The garment of claim 2 wherein each of the surfaces has a weatherability characteristic different than the weatherability characteristic of at least one of the other surfaces.

6. The garment of claim 1 wherein the coupling means is flexible strip having opposite edges secured respectively to the edges of at least one edge pair.

7. The garment of claim 6 wherein the flexible strip is integral with one of the edges of an edge pair.

8. The garment of claim 1 wherein there is only one coupled edge pair.

9. The garment of claim 8 forming a skirt.

10. The garment of claim 8 forming a torso-pullover article of clothing.

11. The garment of claim 1 wherein there are at least two coupled edge pairs.

12. The garment of claim 11 forming a coat-like article of clothing.

13. The garment of claim 11 further comprising means to releasably fasten together the two coupled edge pairs.

14. The garment of claim 13 wherein the fastening means is slideable through the coupling means whereby the fastening means is usable with any of the four surfaces as an outer surface.

15. The garment of claim 13 wherein the coupling means has opposite sides and the fastening means comprises separate fasteners attached to the opposite sides of the coupling means.

16. The garment of claim 15 wherein the coupling means are flexible strips and each of the fasteners is an elongated fastener extending along substantially the full length of one of the flexible strips.

17. The garment of claim 1 wherein each sheet member comprises two overlying substantially co-extensive layers, each irreversibly connected to the other.

18. The garment of claim 17 wherein the surfaces has a characteristic different than a comparable characteristic of each of the other surfaces.

19. The garment of claim 17 forming a coat-like article of clothing.

20. The garment of claim 17 wherein the coupling means is positioned and secured between the irreversibly connected layers of each sheet member.

21. The garment of claim 20 wherein the flexible strip is integral with one of the opposite edges.

22. The garment of claim 20 comprising:

at least two of said coupled edge pairs;

each of the coupling means being a flexible strip having opposite edges secured to the sheet member edges;

means to releasably fasten together the two coupled edge pairs, the fastening means positioned and secured between the irreversibly connected layers of each sheet member.

* * * * *

UNITED STATES PATENT AND TRADEMARK OFFICE

CERTIFICATE OF CORRECTION

PATENT NO. : 5,029,344

DATED : July 9, 1991

INVENTOR(S) : Thomas D. Shannon and Catherine B. Monnier

It is certified that error appears in the above-identified patent and that said Letters Patent is hereby corrected as shown below:

In Column 5, line 22, after the word "highly" insert the phrase --preferred embodiments having two coupled edge pairs, loop--.

In Column 6, lines 26 and 27, the text is printed incorrectly in that no italics are needed. The text should be printed as follows:

--10*b*. After full extension, as shown in FIG 8, garment 28 is turned inside-out, revealing layers 14*b* and 14*c*, as--.

In Claim 1, line 6, after "each" insert --edge--. In the same claim, line 11, the paragraph starting with "whereby" should start at the far left margin.

In Claim 6, line 2, after "is" insert --a--.

In Claim 18, line 1, after "wherein" insert --each of--.

Signed and Sealed this

Tenth Day of November, 1992

*Attest:*

DOUGLAS B. COMER

*Attesting Officer*

*Acting Commissioner of Patents and Trademarks*